US005440821A

United States Patent [19]

Hamrin

[11] Patent Number: 5,440,821

[45] Date of Patent: Aug. 15, 1995

[54] METHOD AND A DEVICE OF TREATING A CONTINUOUS MATERIAL WEB WITH INFRARED LIGHT AND HEATED AIR

[75] Inventor: Karl-Arvid Hamrin, Kungsör, Sweden

[73] Assignee: Infrarodteknik AB, Sweden

[21] Appl. No.: 137,104

[22] PCT Filed: Apr. 21, 1992

[86] PCT No.: PCT/SE92/00256

§ 371 Date: Oct. 19, 1993

§ 102(e) Date: Oct. 19, 1993

[87] PCT Pub. No.: WO92/18693

PCT Pub. Date: Oct. 29, 1992

[30] Foreign Application Priority Data

Apr. 22, 1991 [SE] Sweden ..... 9101194

[51] Int. Cl.[6] ..... F26B 3/34

[52] U.S. Cl. ..... 34/267; 34/273; 34/420; 34/68

[58] Field of Search ..... 34/266, 273, 274, 267, 34/268, 269, 418, 419, 420, 421, 278, 68; 101/424.1; 219/388

[56] References Cited

U.S. PATENT DOCUMENTS 3,623,235 11/1971 Smith, Jr. ..... 34/273
4,586,268 5/1986 Fleissner ..... 34/273
4,783,908 11/1988 Pabst ..... 34/273
4,882,852 11/1989 Kautto ..... 34/273
5,216,820 6/1993 Green et al. ..... 34/273
5,317,127 5/1994 Brewster, Jr. et al. ..... 34/273

FOREIGN PATENT DOCUMENTS 454707 5/1988 Sweden .
455709 8/1988 Sweden .
87/05644 9/1987 WIPO .

*Primary Examiner*—Denise L. Gromada
*Attorney, Agent, or Firm*—Davis, Bujold & Streck

[57] ABSTRACT

A method and a device (1) to treat a paper web (12) by using air, which flows around and cools the infrared lamps (4), to impinge against the paper web and thereafter be removed. A glass plate (9), supported by a pair of glass holders (8), is used to shield the paper web from the infrared lamps. In order to improve the total efficiency and, in particularly, to achieve even and efficient drying of the paper web by using less energy, the cooling air outlets adjacent the glass holders are designed as adjustable width nozzles (19) to direct the heated air against the paper web. The nozzles extend across the entire width of the paper web and the cooling air is ejected from the nozzles at high speed thereby forming an air knife to tear apart the boundary layer of humid air which follows the paper web and subjects the paper web to a more intense heat treatment.

14 Claims, 2 Drawing Sheets

A-A

A
A

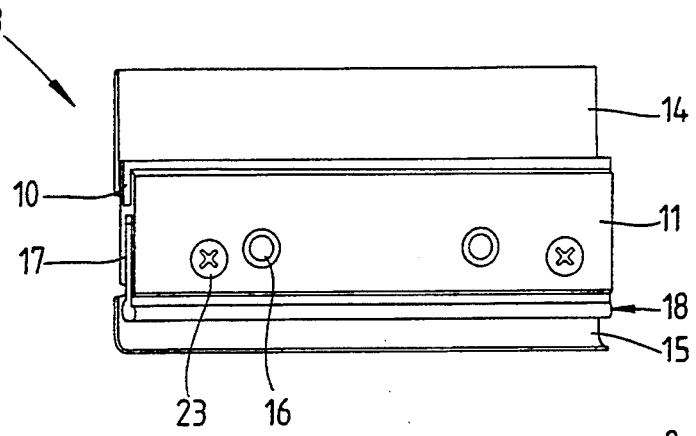
FIG. 4A
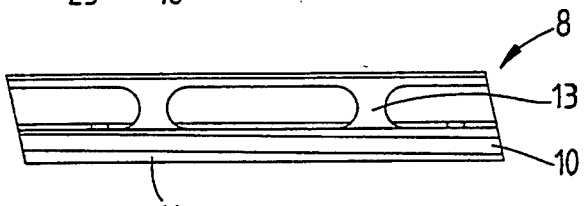
FIG. 4B
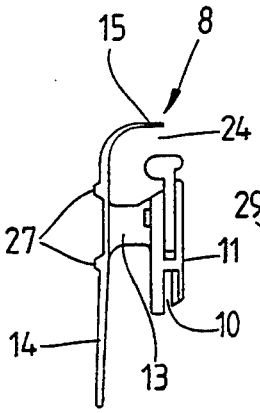
FIG. 4C
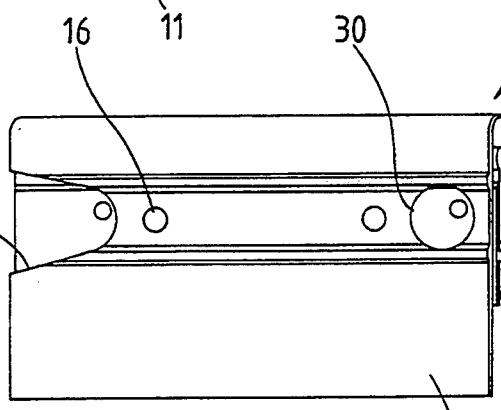
FIG. 4D
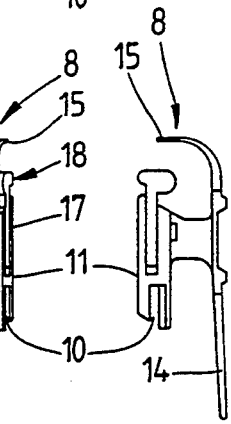
FIG. 4E
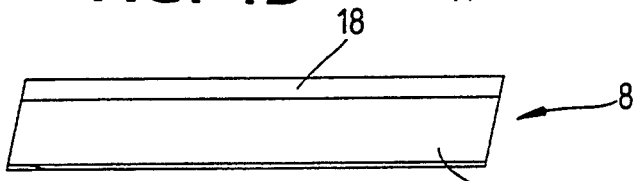
FIG. 4F
FIG.5
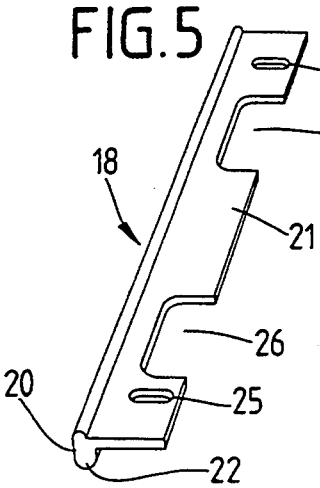
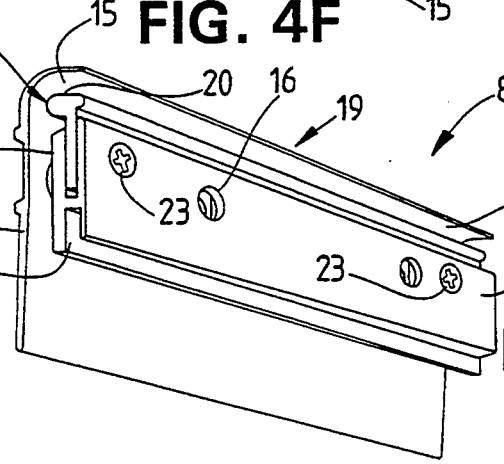
FIG. 4G

METHOD AND A DEVICE OF TREATING A CONTINUOUS MATERIAL WEB WITH INFRARED LIGHT AND HEATED AIR

The present invention relates to a method of treating a continuous material web, particularly a paper web, according to the preamble to patent claim 1. Also, the invention relates to a device designed to carry out the method according to patent claim 1, which device is defined in more detail in the first device claim.

When paper materials are dried, a continuous paper web is run past one or several arrays of infrared heat elements. These elements comprise infrared lamps, mounted in reflector frameworks and separated from the paper web by means of glass plates in order to reduce the fire hazard and protect the lamps. Thus, the lamps must then be cooled and also the glass plates and the holders of the latter, because very high temperatures are reached. In order to obtain such a cooling, the area behind the reflector frameworks and their sheets as well as the glass holders is usually pressurized and the cooling air which is used is allowed through a system of cavities to flow past all the parts which are to be cooled and finally to leave the heat elements and flow against the paper web, from which the air is sucked and possibly reused in the drying process.

As to the above-mentioned conventional infrared heat elements the cooling air flows out usually through lines of holes or not aerodynamicly designed gaps across the web, which means that the cooling air is diffused very quickly close to the holes and reaches the paper web with a comparatively low speed. The speed usually is so low, that the boundary layer of humid air along the paper web surface and following it is not completely broken through. Consequently, the cooling air which flows against the paper web does not have a sufficient drying action, and thus several infrared heat elements are needed and/or an increased radiation intensity and amount of supplied energy. Also, when hole patterns are used, they may not cover the paper web evenly in the perpendicular direction, a streak effect and consequently an uneven drying effect being obtained. Also, the holes and the gaps respectively cannot be adjusted and thus, the cooling air supply cannot be adjusted afterwards. The manufacturing and/or assembly costs can also be troublesome in conventional plants.

WO-A-87/005644 relates to an air-float drier, particularly for paper webs, a number of units including ventilation and infrared heat radiation devices being mounted on alternately opposite sides of a web which is to be dried. By means of the ventilation equipment air jets are directed substantially parallel to the web and the humid boundary layer of which consequently is not substantially influenced by the air jets, the main task of which is to bring about a pressurization in front of the infrared heat radiation equipment in order to bend the web away from said equipment and support or stretch it in this way. As is realized, the entire drying device is very bulky and expensive as regards its manufacturing, assembly and operation, its energy consumption being very large. One of the drawbacks of the device as to its drying effect is also that the ventilation air, which is supplied against the paper web, is not allowed to pass through the infrared heat radiation equipment to become heated there to an elevated and consequently drying-efficient temperature but is circulated around said equipment, whereas the air which passes through said equipment is removed through cavities 23 and 31 to be recirculated within the plant. The dimensions of the units are large and consequently the drying units of the entire assembly are very bulky, and how the ventilation air is taken care of is not discussed.

SE-B-404 213 relates to a device for drying a moving material web without a heat radiation equipment, the ventilation air being ejected against the material web through a screen of holes, which have different fimensions. It is true that the air is ejected perpendicularly to the web surface, a continuous air-float effect being obtained, but the air stream unresiliently hits the boundary layer on the material web without being able to rip it open in any way. This drying device apparently is not very efficient and useful in applications, in which a maximum drying is to be accomplished within a minimum area, the supplied energy being utilized in a maximum way.

SE-B-455 709 relates to a combined infrared radiation and ventilation-drier, e.g. for paper webs. However, the ventilation air is not directed against the web at all but is run parallel to it, no boundary layer-influence at all taking place. Of course, the drier in this way has a strongly reduced efficiency and the energy consumption is large without being of any sufficient service.

The object of the present invention is to as regards what has been discussed above improve and further develop the conventional methods and devices for treating continuous material webs.

This object is achieved by carrying out a method of the type described in the introductory portion above in accordance with the characterizing clause of patent claim 1. Also, said object is achieved by means of a device according to the first device claim.

Additional characterizing features and advantages of the invention are set forth in the following description, reference being made to the accompanying drawings showing a preferred but not limiting embodiment and in which:

FIG. 4 shows various views of a glass holder according to the invention; and FIG. 5 is a view of one part of the glass holder shown in FIG. 4.

Figures 1, 2, 3:
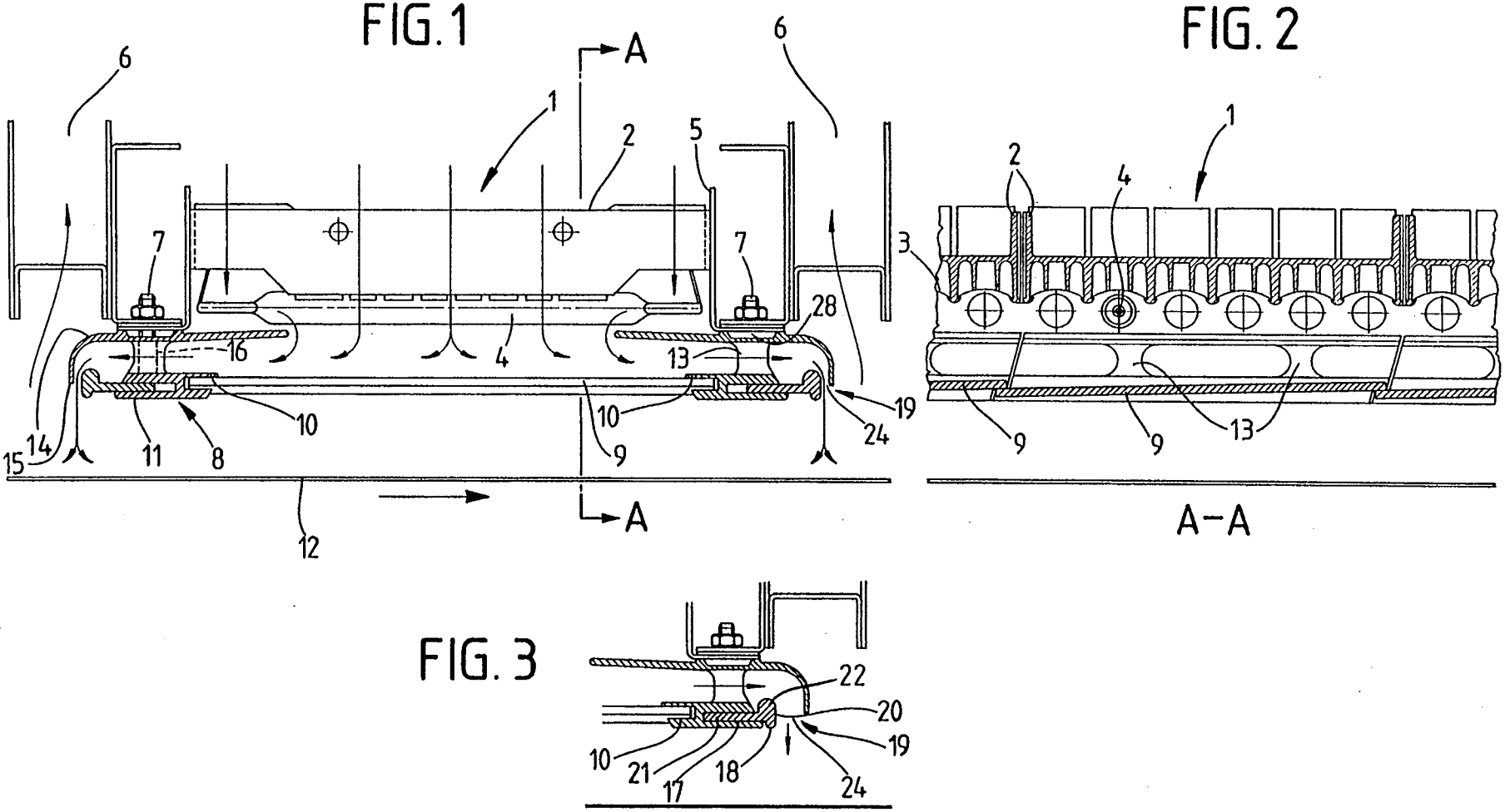
FIG. 1 shows a device according to the invention in a vertical sectional view.
FIG. 2 is a view along line A—A in FIG. 1.
FIG. 3 shows a detail according to FIG. 1 having a completely open damper.

In the drawings a device 1 according to the invention is shown in its entirety. It comprises a reflector framework with reflector sheets 3 and infrared lamps 4. The frameworks are suspended in mounting means 5. In connection with the frameworks there preferably are exhaust air ducts 6 adjacent the two ends, through which ducts the predominant portion of the intake air, ejected towards the paper web, is removed, e.g. by means of negative pressure, not shown in detail. The intake air can be supplied by a fan, not shown, and flow through said frameworks in a way known per se and not shown in detail here.

Glass holders 8 are mounted below said mounting means 5, e.g. screwed on by means of screws 7 and in pairs support glass plates 9, which are inserted into grooves 10 in a lower holder part 11, which suitably is designed as a flat member, which extends in a plane parallel to and at a distance above a passing paper web 12. The two longitudinal sides of the list suitably are bevelled below and/or above the plane of the glass plates.

Glass holder part 11 suitably is made integral with e.g. two spacers 13, mounted at a distance from each other, and with a guide part 14 mounted above them, which latter is plate-shaped with an outer longer side, which is smoothly bent downwards towards the paper web and thus forms a guided flange 15. Different thicknesses of material can be used along the cross-section of the entire guided part, the flange e.g. being considerably thinner. Guide part 14 without its guide flange extends at least approximately in a plane-parallel direction in relation to holder part 11. A minor convergence can possibly be used towards the flange at the inner half of guide part 14.

The fastening screws of the glass holders suitably extend through holes 16, which extend in a central direction through spacers 13 and the adjacent areas of parts 11 and 14.

There is also a groove 17 in the outwardly turned long edge of parts 11, which groove is designed to suitably displaceably in the longitudinal direction of the paper web receive a damper 18, which is a flat member 21 with the exception of the outer long edge, namely the edge facing flange 15, which suitably is thick and forms one side of a nozzle gap 19, the other side of which is formed by stationary flange 15. Said one side is a damper surface 20 having a plane which is parallell to flange 15 and suitably extends on the two sides of the plane, e.g. a center plane formed by said flat member 21. In connection with its plane-parallel extension surface 20 continues in a lower and an upper bend and the upper bend radius may be twice as large as the lower one. The bends are approximately half circular-cylindrical in such a way, that above member 21 a twice as wide and/or thick guide bead 22 is obtained as compared to a guide bead below member 21. Thanks to the described design of the damper an efficient cooling air flow is obtained at the inlet of the nozzle as well as at its outlet.

As is shown in the drawings the damper can be adjusted into various positions by inserting it into groove 17 to different depths and locked in these positions by means of screws 23 fastened in list 11. In this way a nozzle gap 24, formed by flange 15 and surface 20, is adjusted steplessly with a great accuracy. The free long edge of the flange can thus advantageously end approximately in front of the central part of surface 20 as regards its extension in a transversal direction in relation to the paper web. Flange 15 is in its turn suitably positioned in front of the center of the corresponding exhaust air duct 6 as regards its extension in the longitudinal direction of the paper web. The gap width can be e.g. 4–11 mm and as large as 16 mm without the damper.

Flat member 21 is provided with holes 25, adjacent its ends and oblong in the displacement direction of the member and designed to surround screws 23. Between holes 25 there are recesses 26 in the flat list about spacers 13. Guide part 14 is on its free side provided with longitudinally through locating ribs 27, which have a trapezoidal profile, at either side of spacers 13 in order to hold and be positioned on raised portions 28, which extend downwards from the ends of each unit 1. Also, guide part 14 is provided with holes 29 and 30, designed to render possible and facilitate respectively an assembly and disassembly work.

Since, as is shown in the drawing, a series of devices according to the invention can be joined to each other in order to bridge the whole width of the paper web, the mutually adjacent device edges preferably being oblique, an uninterrupted gap is obtained and consequently a streakless treatment of the paper web as to heat treatment as well as to cooling air supply. The last mentioned supply has never before been supposed to also result in a treatment but merely as a certain ejection zone for consumed cooling air. Thanks to the characterizing features of the present invention, also the feature that the cooling air can be strongly pressurized and consequently can have a high ejection speed through the nozzles, it is possible to transform the consumed cooling air, which in fact is a strongly heated exhaust air, to an air-knife, which extends across all the width of the paper web and with a speed of up to 70 m/sec. flows towards the paper web and efficiently penetrates the above-described boundary layer along the paper web and rips open this layer adjacent the inlet to the first nozzle. In connection with this a forced drying-process can take place, since said boundary layer, which has been ripped open, now has a strongly reduced moisture content and absorbs less heat radiation as well as does not have a restraining effect on the moisture disappearance from the paper web any longer. The remaining parts of the boundary layer which has been ripped open are subsequently attacked on the downstream side of the second nozzle and also in this area takes place a more efficient vacuum removal of a major boundary layer portion in the exhaust air than what has been the case before, which also results in a forced drying downstreams of the IR-equipment.

The glass plates can form a closed unit across the width of the paper web, which does not allow exhaust air to flow through it, or a certain advantageous exhaust air discharge can take place, e.g. due to a mutual overlapping of the glass plates in a known way, which allows a small amount of air to flow through the overlapping zones. Such a limited outflow may contribute to the advantageous total efficiency of the device, i.a. due to an improved cleaning of said glass surfaces.

The characterizing features of the invention are: The designed nozzle (the gap) can be adjusted in a simple fashion to the desired outflow speed in order to meet the requirements of different paper webs. A varying and adjustable outflow speed and a pressure impulse caused thereby against the paper web on the air supply side can in combination with a constant vacuum removal of exhaust air, integrated in the IR-housing, across the width of the web allow the IR-housing to function e.g. as a guide roller regarding the web having an arbitary bending direction. Thus, by adjusting the nozzles of the glass holders with different gap widths across the web different speeds/pressure impulses towards the web for different web sections can be obtained, a positive actuation of the runnability of the paper web being attained, since the IR-housing then functions as a guide roller.

The nozzle is to be designed aerodynamicly in a proper way, in order to develop a satisfactory collected air stream, the maximum velocity of impact of the air against the paper web being insignificantly lower than the outlet-speed, also at a distance of 30–40 mm. If the outlet opening e.g. has sharp edges, turbulences and significant speed reductions are obtained.

The dimensions of the nozzle jointly with the overlapping of the glass plates can result in a pressurization under the plates with outlet speeds of up to 70 m/s and simultaneously a most efficient perpendicular impact blowing is used against the paper web in order to achieve a maximum convection heat transmission and boundary layer effect. The elevated outlet speed, almost twice as large as in conventional systems allows, jointly with the more collected air flow, a considerably improved drying effect, particularly pronounced in IR-positions with a high moisture content in the paper web.

The gap design of the glass holder allows, jointly with the position of the exhaust air duct, placed at a lower level, a maximum portion of the air supplied to the web to be captured and reused in other suitable drying sections in the process.

The adjustable gap width of the glass holders allows the impact flow speed against the paper web to be varied in a simple way in an IR-device to a suitable level for freely running paper webs having a low web tension. It is in this way possible to use the highest suitable supply air speed considering the runnability of each individual paper web and the need of influencing the boundary layer in connection with the drying.

The individual adjustable gap width and then also the impact blow speed, the pressure impulse of each module in the cross-direction of the web allows, jointly with an air exhausting device, mounted across the web and integrated in the IR-housing, i.e. the space above or behind the frameworks, an adjustment of a freely running web having a varying web tension/web handling in the transversal direction, which results in an improved runnability for the web and consequently a reduced web break frequency. A special case of this is the possibility described above to, by means of the guidable pressure impulses of the glass holders transversely to the web allow the IR-housing to function e.g. as a guide roller having a selectable bend direction regarding the web. In this connection it is important to take into consideration also the tension effect, which is obtained due to the suction zones 6 in connection with every blowing gap. A sufficiently large suction force, which is obtained through a corresponding negative pressure in suction ducts 6 will result in a certain web tension before and after each unit 1, positively counteracting and stabilizing the tensioning, which is obtained by means of said air-knives. Since it is easy and simple in a device according to the present invention to steplessly adjust the air supply and the exhaust air amounts as well as the gap width, in this way an excellent instrument is obtained designed to solve e.g. stabilization and break problems of a freely running material web, also in case such a web has a very low surface weight, e.g. about 30 $g/m^2$ and/or a high speed, e.g. about 1000 m/min.

What is claimed is:

1. A heating and ventilation unit for treating a continuous web of material, said unit comprising a housing being open at one end thereof and defining a hollow interior chamber therein, an array of infrared lamps (4) being supported in the chamber proximate to and facing toward the open end of said housing, a pair of glass holders (8) being attached along opposite longitudinal edges of the open end of said housing, a glass plate (9) being supported by said pair of glass holders and extending substantially across the width of the open end, means for providing a flow of cooling air to said housing for cooling said lamps, at least one spacer (13) separating each said pair of glass holders from the longitudinal edges of said housing thereby to define an elongate clearance between each longitudinal edge of said housing and the adjacent glass holder (8), an air flow guide flange (14) attached to each said longitudinal edge of said housing and extending in a plane parallel to said glass plate, each said air flow guide flange (14) having a remote end curving back toward said glass plate holder and terminating in an end portion (15), each said end portion (15) and the adjacent glass holder (8) defining a nozzle gap (19, 24) therebetween extending the entire length of said housing, whereby in use cooling air, supplied by said means for providing cooling air, passes around and cools the lamps (4) and becomes heated, and the heated air exits said housing through the clearances and is directed by the guide flanges (14, 15) through said nozzle gaps (19, 24) to form air knives extending across the longitudinal length of the open end and directed substantially at a right angle relative to said glass plate.

2. A heating and ventilation unit according to claim 1, wherein said means for providing a flow of cooling air and said nozzle gaps (19, 24) provide the air knives with a velocity of up to 70 m/sec.

3. An heating and ventilation unit according to claim 11, in combination with a plurality of other units each comprising a housing being open at one end thereof and defining a hollow interior chamber therein, an array of infrared lamps (4) being supported in the chamber proximate to and facing toward the open end of said housing, a pair of glass holders (8) being attached along opposite longitudinal edges of the open end of said housing, a glass plate (9) being supported by said pair of glass holders and extending substantially across the width of the open end, means for providing a flow of cooling air to said housing for cooling said lamps, at least one spacer (13) separating each said pair of glass holders from the longitudinal edges of said housing thereby to define an elongate clearance between each longitudinal edge of said housing and the adjacent glass holder (8), an air flow guide flange (14) attached to each said longitudinal edge of said housing and extending in a plane parallel to said glass plate, each said air flow guide flange (14) having a remote end curving back toward said glass plate holder and terminating in an end portion (15), each said end portion (15) and the adjacent glass holder (8) defining a nozzle gap (19, 24) therebetween extending the entire length of said housing, whereby in use cooling air, supplied by said means for providing cooling air, passes around and cools the lamps (4) and becomes heated, and the heated air exits said housing through the clearances and is directed by the guide flanges (14, 15) through said nozzle gaps (19, 24) to form air knives extending across the longitudinal length of the open end and directed substantially at a right angle relative to said glass plate; and the plurality of other units being arranged in series with the air knives positioned in an end to end relationship such that the air knives form two continuous elongate air knifes which span the entire width of a web to be dried.

4. A heating and ventilation unit according to claim 1, wherein said unit further comprises at least one vacuum duct (6) located on each sides of said housing adjacent the air flow guide flange (14) for removing the air which exits the nozzle gap (19, 24) after treating a web.

5. A heating and ventilation unit according to claim 1, wherein said unit further comprises a reflector framework (2) mounted adjacent the lamps, remote from said glass plate (9), to reflect radiation from the lamps (4) through said glass plate (9).

6. A heating and ventilation unit according to claim 1, wherein said pair of glass holders (8) are integrally formed with at least two said spacers (13), mounting holes extend through each of said pair of glass holders (8) and through said at least two spacers, and threaded bolts (23) engage with the mounting holes and with mountings holes provided in said housing to attach said pair of glass holders (8) to said housing.

7. A heating and ventilation unit according to claim 1, wherein each said glass holder (8) has a longitudinally extending groove (17) provided in a side thereof remote from the open end, a planar inner portion (21) of an elongate damper (18) is received in each said groove and an outer portion of said damper extends from said groove and terminates in an outer end portion that cooperates with the flange (14, 15) to define said nozzle gap (19).

8. A heating and ventilation unit according to claim 7, wherein said outer portion of each said damper has a thickness that is greater than that of the inner planar portion and has a planar outer surface (20) which extends substantially perpendicular to said glass plate and substantially parallel to the end portion (15) of the guide flange (14), and opposed longitudinally edges of the end surface (20) are curved back toward the inner portion (21) of the damper and thereby define a pair of opposed longitudinally extending hemi-cylindrical beads (18, 22).

9. A heating and ventilation unit according to claim 8, wherein the hemi-cylindrical bead (22) located proximate to the open end has a radius that is about twice as large as the hemi-cylindrical bead (18) remote from the open end.

10. A heating and ventilation unit according to claim 7, wherein said pair of glass holders (8) are integrally formed with at least two said spacers (13), mounting holes extend through each of said pair of glass holders (8) and through said at least two spacers, each said damper (18) has two transverse slots (25) extending therethrough, and threaded bolts (23) engage with the mounting holes and said transverse slots (25) to secure said pair of glass holders (8) and said dampers to said housing via threaded holes provided in said housing.

11. A heating and ventilation unit according to claim 10, whereby the transverse slots (25) are sized and positioned such that the dampers (18) may be adjusted at an angle so that said nozzle gap has an increasing width along the length of said unit.

12. A heating and ventilation unit according to claim 10, wherein said transverse slots (25) are sufficiently long such that the nozzle gaps are adjustable to a width of from about 4 mm. to about 11 mm.

13. A heating and ventilation unit according to claim 10, wherein the guide flanges (14, 15) are integrally formed with the spacers (13) and extend from a side of the spacers remote from said open end.

14. A method of treating a continuous web of material by providing a unit for treating a continuous web of material, said method comprising the steps of:

using a housing which is opened at one end thereof and defines a hollow interior chamber therein;

supporting an array of infrared lamps (4) in the chamber proximate to and facing toward the open end of said housing;

attaching a pair of glass holders (8) along opposite longitudinal edges of the open end of said housing;

supporting a glass plate (9), by said pair of glass holders, which extends substantially across the width of the open end;

separating each said pair of glass holders from the longitudinal edges of said housing with at least one spacer (13) thereby to define an elongate clearance between each longitudinal edge of said housing and the adjacent glass holder (8);

providing an air flow guide flange (14) which extends from each said longitudinal edge of said housing in a plane parallel to said glass plate, each said air flow guide flange (14) having a remote end curving back toward said glass plate holder and terminating in an end portion (15);

defining a nozzle gap (19, 24), extending the entire width of the web to be dried (12), between each said end portion (15) and the adjacent glass holder (8);

supplying cooling air to said housing which passes around and cools the lamps (4) and becomes heated;

exhausting said heated air from said housing through the clearances; and directing said heated air, via the guide flanges (14, 15), through said nozzle gaps (19, 24) to form air knives extending across the longitudinal length of the open end and directed substantially at a right angle relative to said glass plate.

* * * * *